US009650800B2

(12) United States Patent
Close

(10) Patent No.: US 9,650,800 B2
(45) Date of Patent: May 16, 2017

(54) CURB SYSTEM FOR A CONCRETE CONTAINER

(71) Applicant: Dutchland, Inc., Gap, PA (US)

(72) Inventor: Steven R. Close, Lakewood, CO (US)

(73) Assignee: Dutchland, Inc., Gap, PA (US)

( * ) Notice: Subject to any disclaimer, the term of this patent is extended or adjusted under 35 U.S.C. 154(b) by 0 days.

(21) Appl. No.: 15/054,724

(22) Filed: Feb. 26, 2016

(65) Prior Publication Data

US 2016/0251868 A1 Sep. 1, 2016

Related U.S. Application Data

(60) Provisional application No. 62/121,874, filed on Feb. 27, 2015.

(51) Int. Cl.
*E04H 7/18* (2006.01)
*E04H 7/26* (2006.01)

(52) U.S. Cl.
CPC ..... *E04H 7/18* (2013.01); *E04H 7/26* (2013.01)

(58) Field of Classification Search
CPC .... E04H 7/18; E04H 7/26; E04H 7/20; E04H 7/28; E04B 2001/2684; E04B 2001/2463; E02D 27/02
USPC ..... 52/168, 223.3, 293.1, 293.2, 294, 295, 52/274, 264
See application file for complete search history.

(56) References Cited

U.S. PATENT DOCUMENTS 2,865,267 A * 12/1958 Bailey ..... E02D 29/16 404/56
3,280,525 A * 10/1966 Crowley ..... E04H 7/20 52/223.3
3,385,016 A * 5/1968 Crom ..... E04B 1/6806 52/249
3,747,292 A 7/1973 Pilish
4,015,383 A * 4/1977 Crowley ..... E04H 7/20 52/169.4
4,098,047 A * 7/1978 Weber ..... E04B 1/6807 404/68
4,126,976 A * 11/1978 Crowley ..... E04H 7/20 52/169.7
5,248,219 A 9/1993 Heiler, Jr.
5,408,793 A * 4/1995 Dykmans ..... B65D 88/34 156/143
5,590,497 A * 1/1997 Moore ..... E04H 7/20 52/223.3
5,893,479 A 4/1999 Berberat
7,111,751 B2 * 9/2006 Copley ..... E04H 7/18 220/3.4
8,336,263 B2 12/2012 Schultz et al.

* cited by examiner

*Primary Examiner* — Brian Glessner
*Assistant Examiner* — Adam Barlow
(74) *Attorney, Agent, or Firm* — Barley Snyder

(57) ABSTRACT

A curb system for a concrete container is disclosed. The curb system includes a base slab having a planar mounting surface and a wall positioned on the planar mounting surface. An inner curb is positioned on the planar mounting surface adjacent to an inner surface of the wall, and an outer curb is positioned on the planar mounting surface adjacent to an outer surface of the wall. A first expandable waterstop is positioned between the inner curb and the inner surface of the wall. A first waterstop is positioned between the inner curb and the planar mounting surface.

17 Claims, 7 Drawing Sheets

CURB SYSTEM FOR A CONCRETE CONTAINER

CROSS-REFERENCE TO RELATED APPLICATIONS

This application is a non-provisional application claiming the benefit of the filing dates under 35 U.S.C. §119(e) of Provisional Patent Application No. 62/121,874, filed Feb. 27, 2015.

FIELD OF THE INVENTION

The invention is generally related to concrete containers, and more specifically to a curb system for securing concrete container walls.

BACKGROUND

Concrete containers are commonly used for storing various quantities of liquid and solid substances. Traditionally, the fabrication of a concrete container begins by pouring a concrete base slab. Keyways are shaped into the top surface of the base slab, into which the bottom end of concrete walls are set and shimmed. The keyways provide a form of restraint along the bottom of the concrete walls during container construction. Non-shrink grout and various adhesives are utilized to fill in any gaps between the keyway and the concrete wall, and make the system watertight.

While keyways work well for many applications, they are not always structurally appropriate when constructing tall concrete containers. In such applications, the tall height of concrete walls results in a heavy load being placed at the base of the walls. When the concrete containers are filled, shear force is placed on the concrete wall, and in particular, on the keyways and the relatively small portion of the concrete wall inserted in the keyways. The sheer force can result in spalling, grout cracking, and other structural failures in concrete tanks using keyways. There is a need for alternative designs that eliminate the use of keyways in the construction of concrete containers, and instead allow walls to be placed on a planar base slab.

SUMMARY

An object of the invention, among others, is to provide a curb system for a concrete container whereby the walls are set on a planar base slab. The disclosed curb system includes a base slab having a planar mounting surface and a wall positioned on the planar mounting surface. An inner curb is positioned on the planar mounting surface adjacent to an inner surface of the wall, and an outer curb is positioned on the planar mounting surface adjacent to an outer surface of the wall. A first expandable waterstop is positioned between the inner curb and the inner surface of the wall. A first waterstop is positioned between the inner curb and the planar mounting surface.

BRIEF DESCRIPTION OF THE DRAWINGS

The invention will now be described by way of example with reference to the accompanying figures, of which.

DETAILED DESCRIPTION OF THE EMBODIMENT(S)

The embodiments will now be described with reference to the accompanying FIGS. 1-8.

Figure 1:
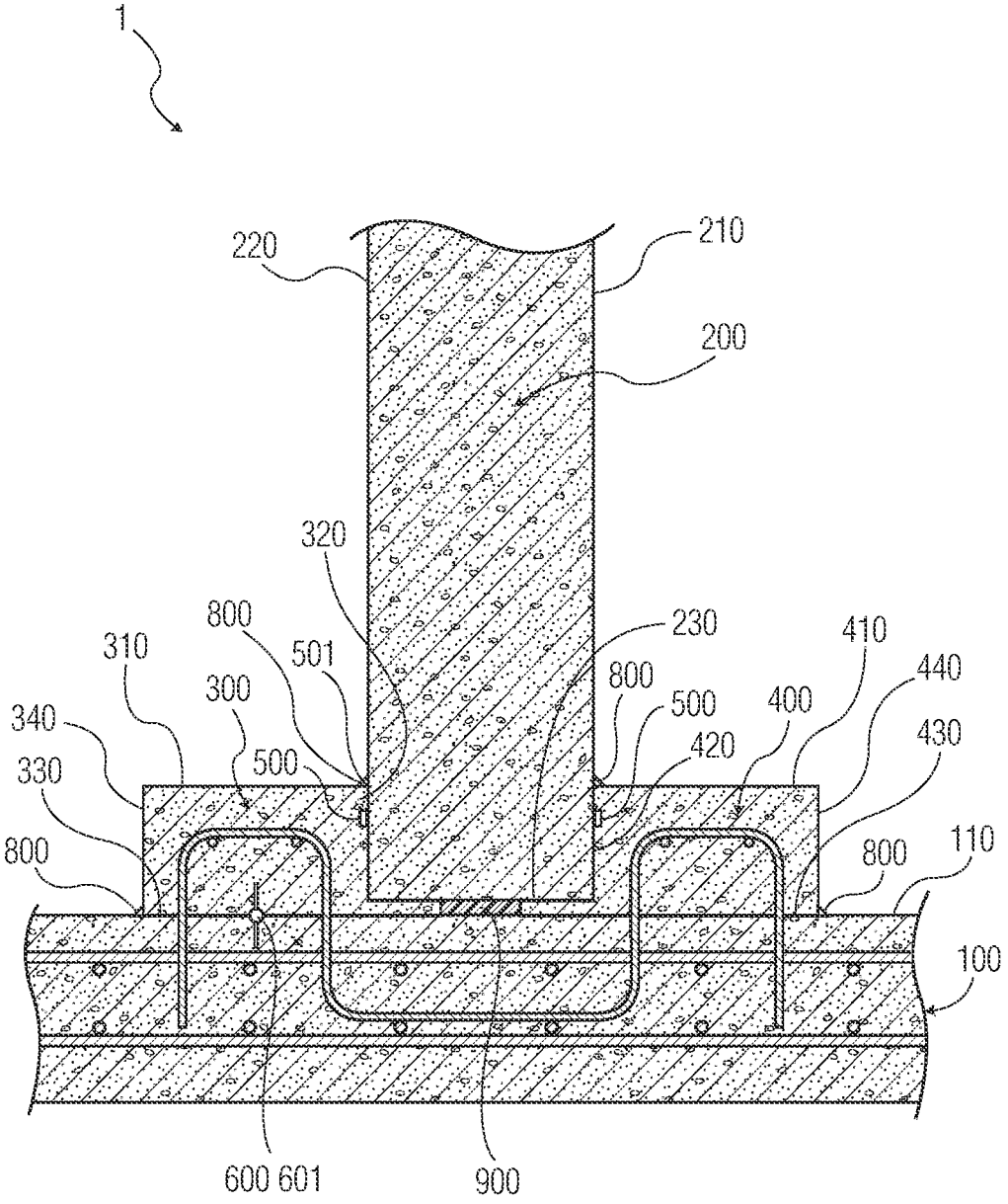
FIG. 1 is a sectional view of a curb system for a concrete container.
Figure 2:
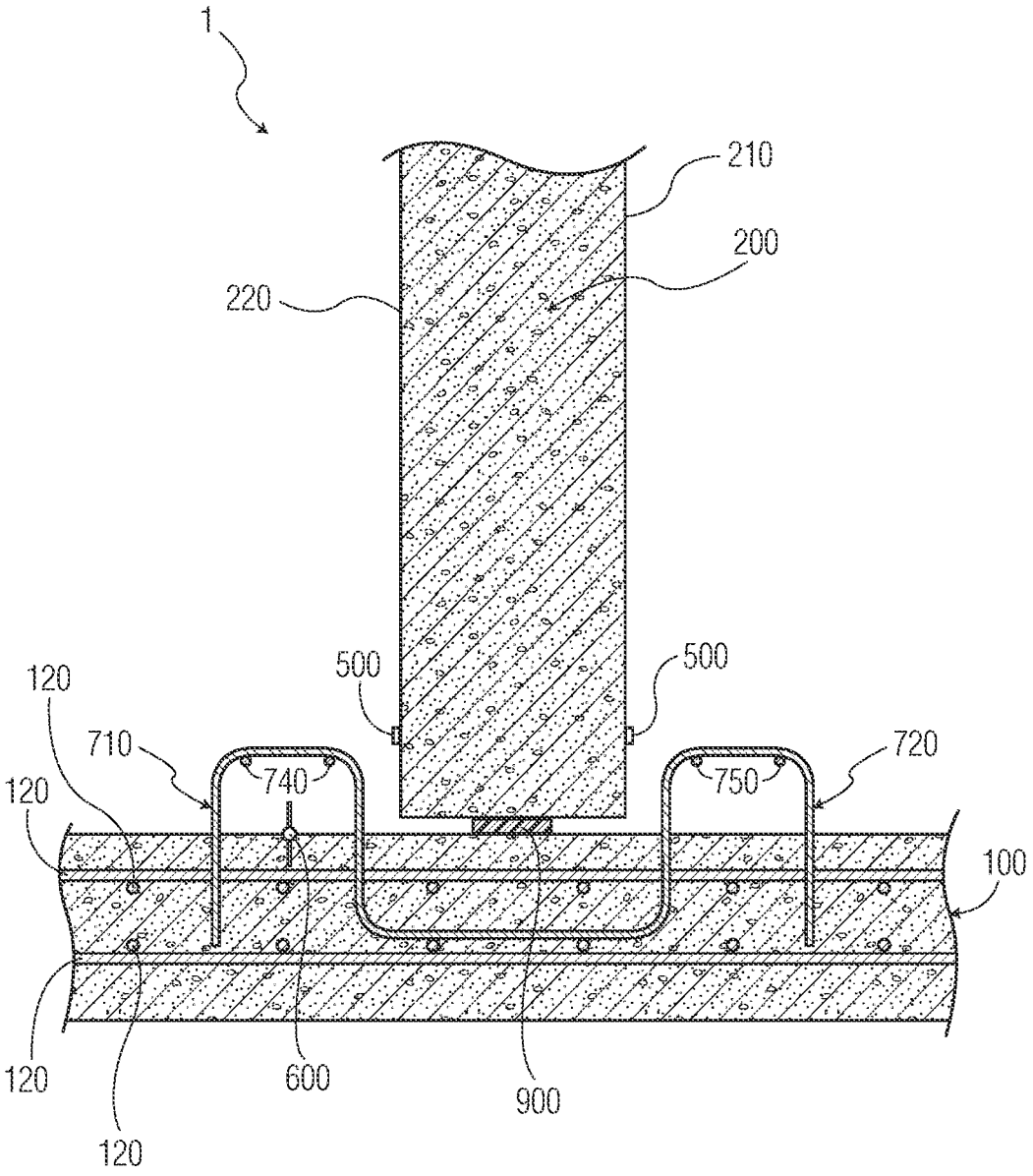
FIG. 2 is a sectional view of the curb system before an inner curb and outer curb have been cast.
Figure 3:
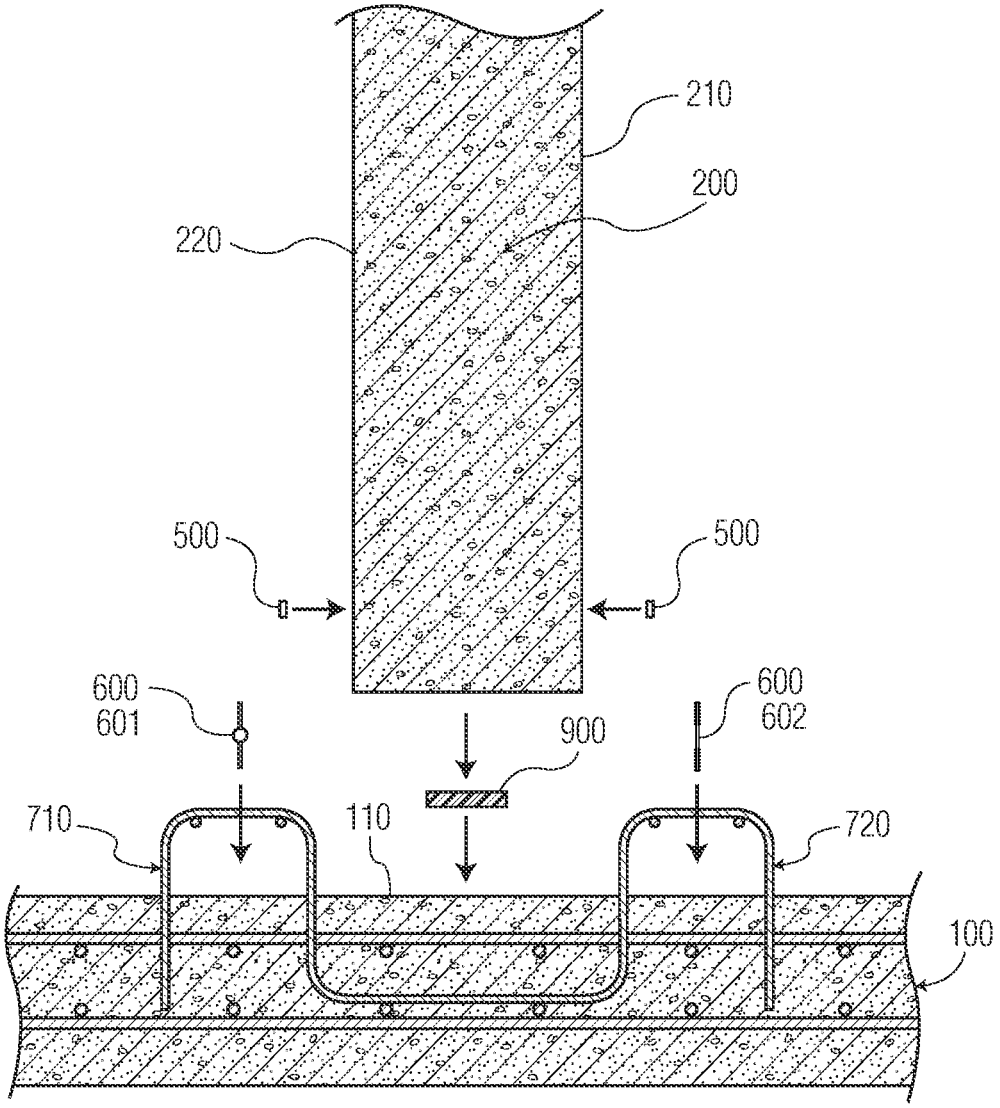
FIG. 3 is a sectional view of the curb system illustrating the wall being placed on a flat, planar surface of a base slab.
Figure 4:
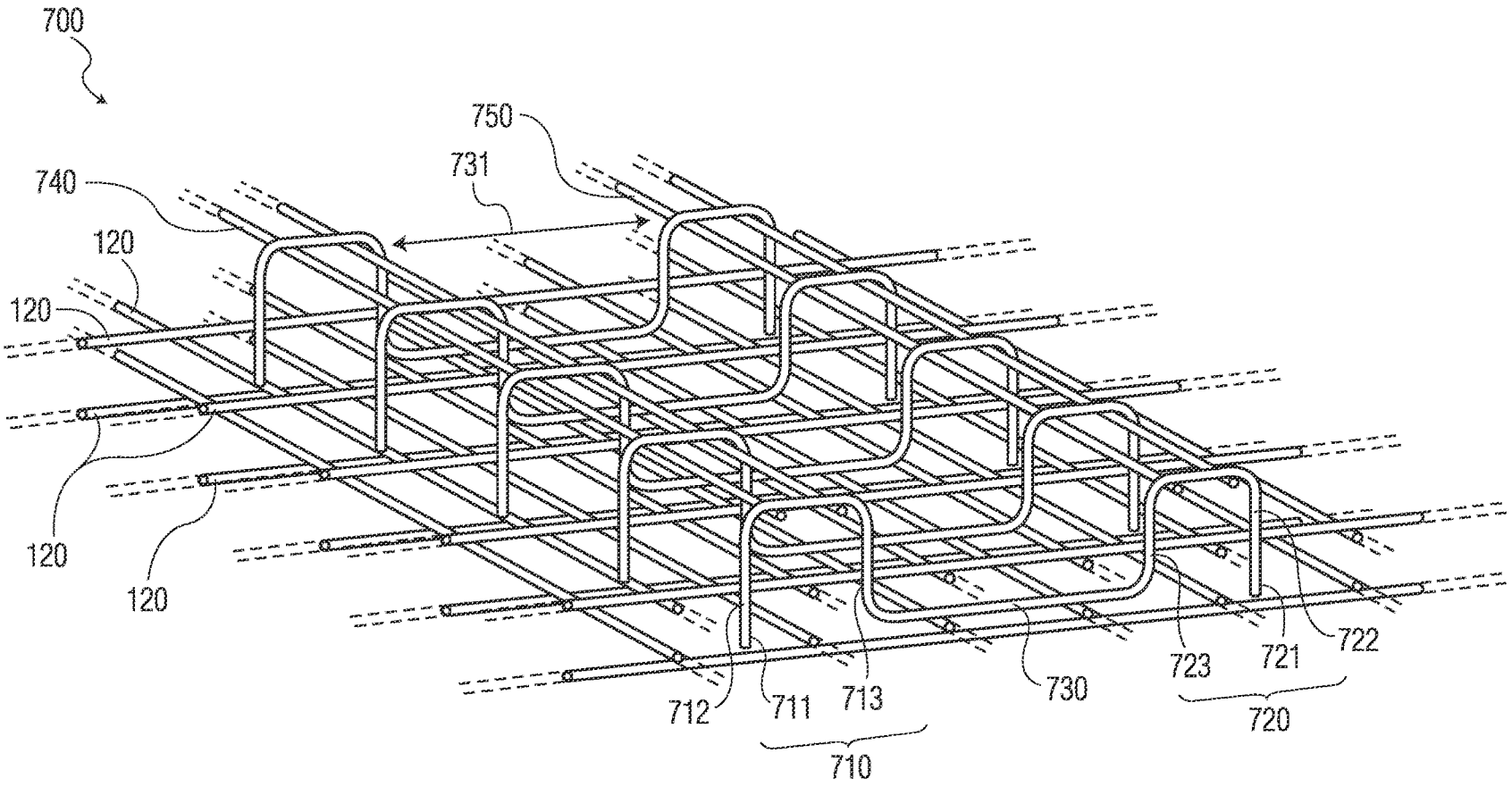
FIG. 4 is perspective view of an assembled plurality of curb reinforcing members and base slab reinforcing members.

With respect to FIG. 1, a curb system for a concrete container 1 is shown having a base slab 100, a wall 200, an inner curb 300, an outer curb 400, a first expandable waterstop 500, a first waterstop 600, and a plurality of curb reinforcing members 700.

The base slab 100 is made of concrete and has a flat, planar mounting surface 110. A plurality of base slab reinforcing members 120 are arranged in the base slab 100 in a grid pattern along a common plane. Multiple layers of base slab reinforcing members 120 in different common planes can be used. As illustrated in FIGS. 1-4, two layers of base slab reinforcing members 120 are arranged in the base slab 100 in a grid pattern along a common plane. In this embodiment, the base slab reinforcing members 120 are made from rods of reinforcing bar ("rebar"), although one of ordinary skill in the pertinent art would appreciate that other suitable reinforcing materials can also be used, such as wire.

The wall 200 is made of precast concrete panels. The wall 200 has an outer surface 210, an inner surface 220, a first base slab contacting surface 230, and a top surface (not shown). The outer surface 210 is located on an exterior face of the wall 200, which defines the exterior periphery of the container 1. The inner surface 220 is located on an inward face of the wall 200, which defines the interior periphery of the container 1.

The inner curb 300 is substantially rectangular in shape, although other shapes such as a square can also be used. The inner curb 300 has a top surface 310, a first wall contacting surface 320, a second base slab contacting surface 330, and an inner facing surface 340.

The outer curb 400 is substantially rectangular in shape, although other shapes such as a square can also be used. The outer curb 400 has a top surface 410, a second wall contacting surface 420, a third base slab contacting surface 430, and an outer facing surface 440.

Figure 6:
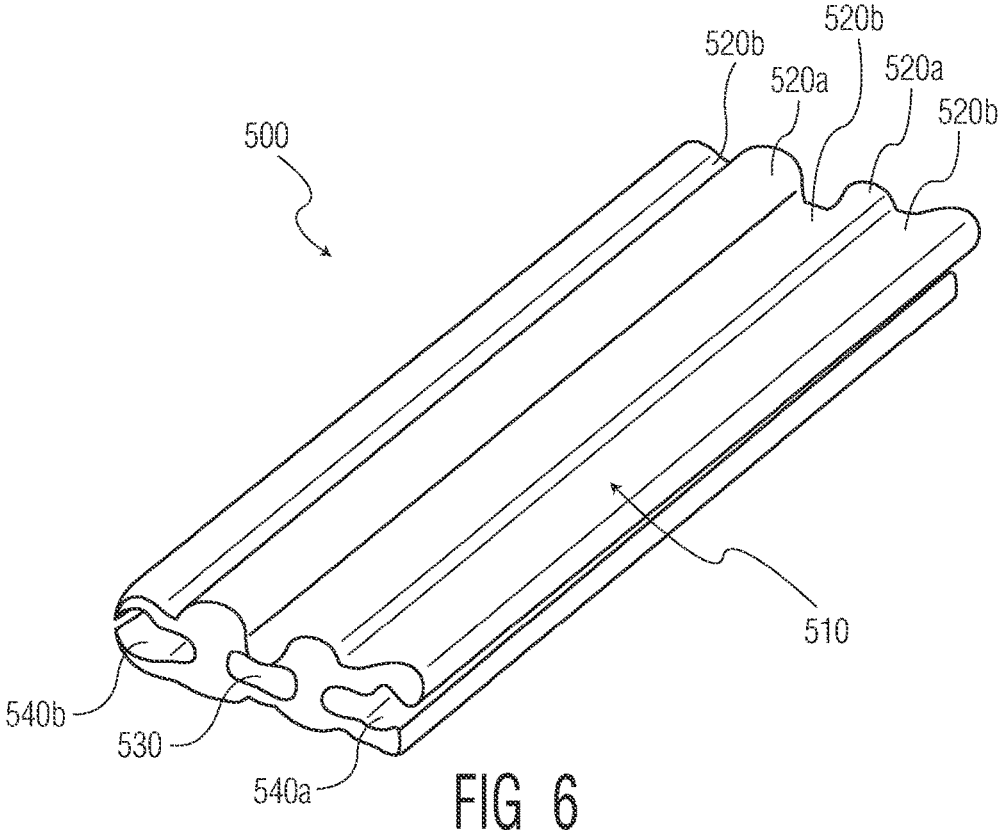
FIG. 6 is a perspective view of an exemplary expandable waterstop.

An embodiment of the first expandable waterstop 500 is illustrated in FIG. 6. The first expandable waterstop 500 can be made from a variety of materials depending on the desired usage of the container 1. Examples of the materials include hydrophobic, extruded thermoplastic resins such as flexible polyvinyl chloride ("PVC"), polyethylene ("PE"), polyurethane, and thermoplastic vulcanizate rubber ("TVP"); or hydrophilic extruded thermosets such as natural rubber, styrene-butadiene rubber, or neoprene rubber. The first expandable waterstop 500 can also include the use of sodium bentonite. The physical properties of the first expandable waterstop 500 are such that when a hydrophobic liquid contacts a first expandable waterstop 500 made from a hydrophobic material, the hydrophobic liquid is absorbed. The absorption causes the first expandable waterstop 500 to swell and expand into cavities and cracks, resulting in a tight seal. Likewise, when a hydrophilic liquid contacts a first expandable waterstop 500 made from a hydrophilic material, the hydrophilic liquid is absorbed. The absorption causes the first expandable waterstop 500 to swell and expand into cavities and cracks, resulting in a tight seal.

The first expandable waterstop 500, as illustrated in FIG. 6, has an elongated body 510 having opposing irregular surfaces of peaks 520*a* and valleys 520*b* extending along the length of the elongated body 510 from a leading end to a distal end. An internal bore 530 longitudinally extends through the center of the elongated body 510 along the length of the elongated body 510 from the leading end to the distal end. Opposing channels 540*a*, 540*b* are positioned along opposing edges of the elongated body 510 and extend from the leading end to the distal end. One of ordinary skill in the pertinent art would appreciate that other shapes can also be used.

Figure 5:
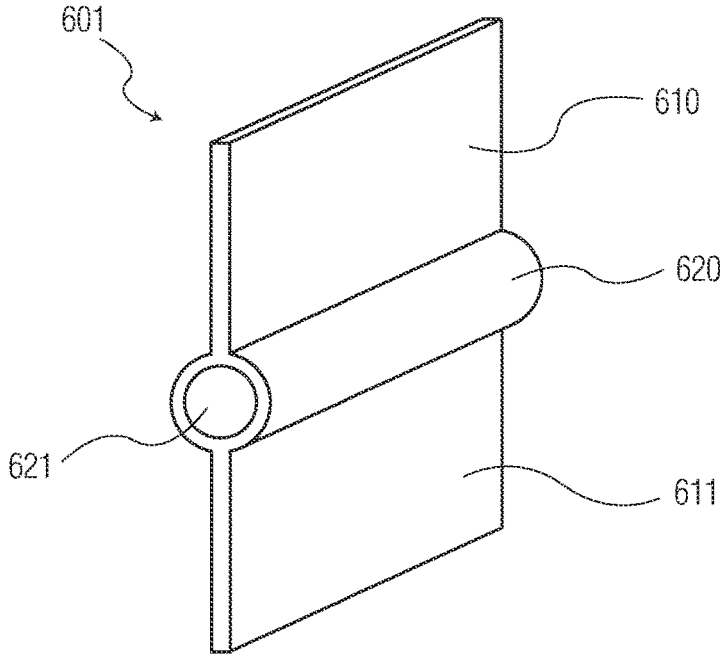
FIG. 5 is a perspective view of an exemplary bulb waterstop.

An embodiment of the first waterstop 600 is illustrated in FIG. 5. In this embodiment, the first waterstop 600 is made from PVC, although other thermoplastic and thermoset materials, such as those used in the first expandable waterstop 500, can also be used.

In the exemplary embodiment shown in FIG. 5, a bulb waterstop 601 is used. The bulb waterstop 601 includes a center bulb 620, a first planar member 610, and a second planar member 611. The center bulb 620 extends along the central portion of the first bulb waterstop 600. The center bulb 620 is tubular in shape, and includes a bore 621 extending along the length of the center bulb 620 from a leading end to a distal end. The first planar member 610 and second planar member 611 are disposed on an exterior surface of the center bulb 620 and project in opposite directions away from the center bulb 620 in a common plane. In FIG. 5, the first planar member 610 and the second planar member 611 extend an equidistance in opposite directions away from the center bulb 620. The first planar member 610 and the second planar member 611 extend along the length of the center bulb 620 from the leading end to the distal end. In another embodiment, the first planar member 610 and the second planar member 611 further include a plurality of ribs positioned along opposite longitudinal surfaces, the ribs projecting perpendicular to the common plane (not shown).

Figure 7:
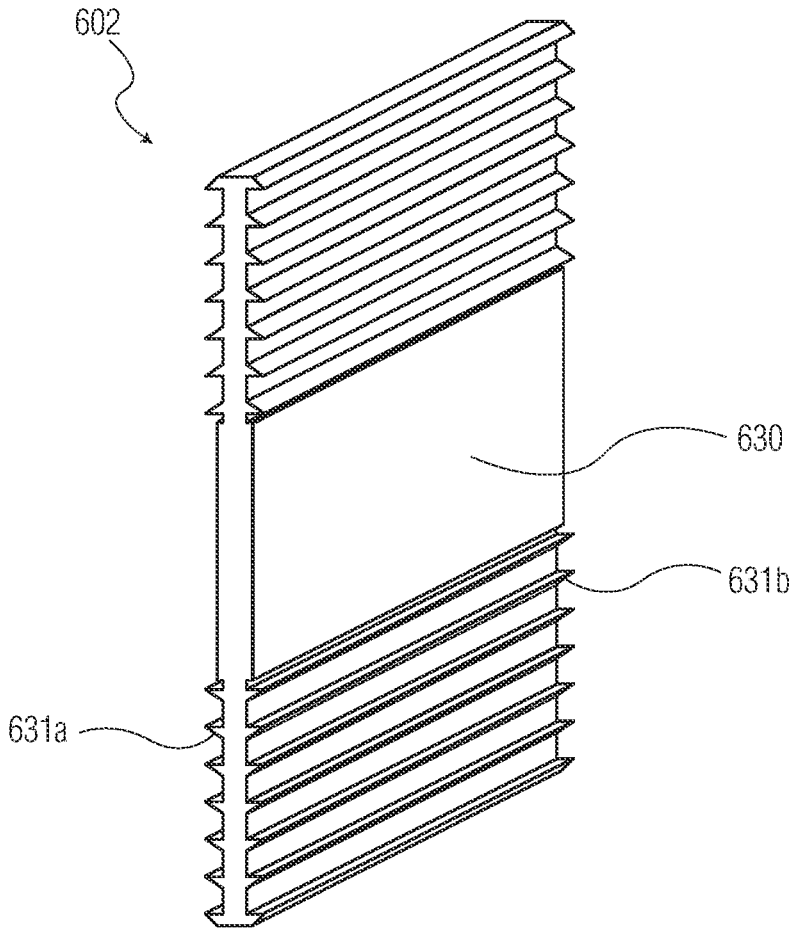
FIG. 7 is a perspective view of exemplary ribbed waterstop.

In another exemplary embodiment, the first waterstop 600 is a ribbed waterstop 602. As shown in FIG. 7, the ribbed waterstop 602 includes an elongated planar member 630 having a first ribbed sidewall 631*a* and an opposite second ribbed sidewall 631*b*.

Further still, one of ordinary skill in the art would appreciate that while the bulb waterstop 601 and ribbed waterstop 602 have been expressly disclosed, other waterstop designs can also be used, including expandable waterstops.

The plurality of curb reinforcing members 700 are disclosed in FIGS. 1-4 and 8, and each individual curb reinforcing member 700 includes an inner curb reinforcing member 710, and an outer curb reinforcing member 720. In an embodiment, the curb reinforcing member 700 further includes a curb connecting member 730. The plurality of curb reinforcing members 700 also include a plurality of inner curb reinforcing crossmembers 740 and a plurality of outer curb reinforcing crossmembers 750.

In the embodiment shown in FIGS. 1-4, the inner curb reinforcing member has a first end portion 711, a first projection portion 712, and a second end portion 713. The outer curb reinforcing member 720 has a third end portion 721, a second projection portion 722, and a fourth end portion 723. The curb connecting member 730 is positioned in the base slab 100 and is connected to the second end portion 713 and the fourth end portion 723. The curb connecting member 730 extends in the base slab 100, parallel with the mounting surface 110 to form a wall receiving space 731 between the first projection portion 712 and the second projection portion 722. The length of the curb connecting member 730 determines the width of the wall receiving space 731. The length can be varied to correspond to the width of the wall 200 to be received in the wall receiving space 731.

Figure 8:
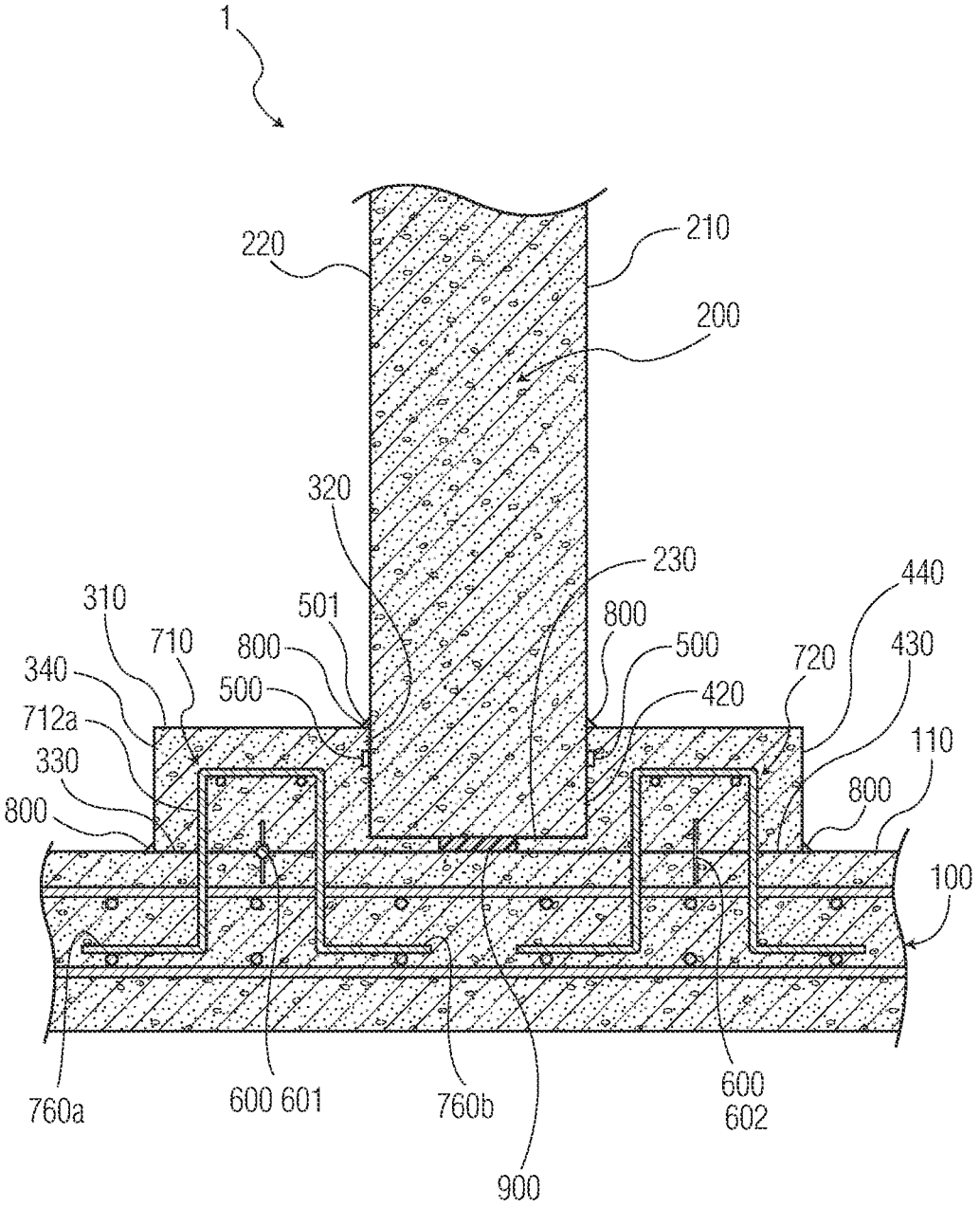
FIG. 8 is a sectional view of a curb system for a concrete container according to another embodiment of the invention.

In another exemplary embodiment shown in FIG. 8, the inner curb reinforcing member 710 and the outer curb reinforcing member 720 are individual, stirrup-shaped members. Both curb reinforcing members 710,720 have a first anchor portion 760*a*, a first projection portion 712*a*, and a second anchor portion 760*b*.

The curb reinforcing members 700 and the curb reinforcing crossmembers 740,750 are made of rebar, wire, or other structural reinforcing material.

In an embodiment, an elastomeric sealant 800 is employed as a sealant. The elastomeric sealant 800 can be synthetic rubber, polyurethane, silicone, acetoxy silicone, or other common elastomeric sealants 800 know to one of ordinary skill in the pertinent art.

Assembly of the major components will now be described in detail.

The concrete base slab 100 has a flat, planar mounting surface 110. A plurality of curb reinforcing members 700 are positioned in the base slab 100, and are spaced at set distances from each other. See FIGS. 3 and 4.

In the exemplary embodiment shown in FIGS. 1-4, the first end portion 711 of each individual inner curb reinforcing member 710 is positioned in the base slab 100. The first projection portion 712 projects from the first end portion 711 out of the base slab 100, perpendicular to the mounting surface 110. The first projection portion 712 then bends 90 degrees, extends a distance parallel to the mounting surface 110, then bends 90 degrees to form an inverted U-shape. The second end portion 713 extends from the first projection portion 712 and is positioned in the base slab 100.

In the exemplary embodiment shown in FIG. 8, where individual, stirrup-shaped inner and outer curb reinforcing members 710,720 are used, the first anchor portion 760*a* is positioned in the base slab 100. The first projection portion 712*a*, at a first end, connects to the first anchor portion 760*a* and projects out of the base slab 100 perpendicular to the mounting surface 110. The first projection portion 712*a* then bends 90 degrees, extends a distance parallel to the mounting surface 110, then bends 90 degrees to form an inverted U-shape, and extends back into the base slab 100. The second anchor portion 760*b* extends from an opposite second end of the first projection portion 712*a* and is positioned in the base slab. In the exemplary embodiment of FIG. 8, the first anchor portion 760*a* and the second anchor portion 760*b* extend in opposite directions from the respective ends of first projection portion 712*a*. As would be appreciated by one with ordinary skill in the art, however, the first anchor portion 760*a* and the second anchor portion 760*b* could alternatively extend in the same direction from the respective ends of the first projection portion 712*a*.

A pair of inner curb reinforcing crossmembers 740 are positioned on an inner face of the first projection portion 712. Each individual inner curb reinforcing crossmember 740 extends between each individual first projection portions 712 along the entire length of the plurality of inner curb reinforcing members 710.

The third end portion 721 of each individual outer curb reinforcing member 720 is positioned in the base slab 100. The second projection portion 722 projects from the third end portion 721 out of the base slab 100, perpendicular to the mounting surface 110. The second projection portion 722 then bends 90 degrees, extends a distance parallel to the mounting surface 110, then bends 90 degrees to form an inverted U-shape. The fourth end position 723 extends from the second projection portion 722 and is positioned in the base slab 100. See FIGS. 1-4.

A pair of outer curb reinforcing crossmembers 750 are positioned on an inner face of the second projection portion 722. Each individual outer curb reinforcing crossmember 750 extends between each individual second projection portions 722 along the entire length of the plurality of outer curb reinforcing members 720.

In the embodiments shown in FIGS. 1-4, the curb connecting member 730 is positioned in the base slab 100, and extends parallel with the mounting surface 110 between the inner curb reinforcing member 710 and the outer curb reinforcing member 720. The curb connecting member 730 is connected to the second end portion 713 and the fourth end portion 723. The length of the curb connecting member 730 determines the width of the wall receiving space 731, positioned between the inner curb reinforcing member 710 and the outer curb reinforcing member 720.

A shim 900 is placed on the mounting surface 110 at an approximate midpoint between the second end portion 713 and the fourth end portion 723 in the wall receiving space 731. The precast concrete wall 200 is then positioned in the wall receiving space 731. See FIGS. 3 and 4. The first base contacting surface 230 contacts the shim 900 and rests on the mounting surface 110. The outer surface 210 faces the outer curb reinforcing members 720, and is positioned closer to the fourth end portion 723 than to the third end portion 721. The inner surface 220 faces the inner curb reinforcing members 710, and is positioned closer to the second end portion 713 than the first end portion 711. See FIGS. 1 and 2.

In an embodiment shown in FIG. 1, the first expandable waterstop 500 is positioned on the inner surface 220 of the wall 200, between the inner curb 300 and the wall 200. In another embodiment, a second expandable waterstop 500 is positioned on the outer surface 210 of the wall 200, between the outer curb 400 and the wall 200. (not shown)

In an embodiment shown in FIG. 1, the first waterstop 600 is positioned on the mounting surface 110, between the first end portion 711 and the second end portion 713 of the inner curb 300. In another embodiment, an additional waterstop 600 is also positioned on the mounting surface 110, between the third end portion 721 and the fourth end portion 723 of the outer curb 400.

When the bulb waterstop 601 is used, the second planar member 611 is positioned in the base slab 100, the center bulb 620 is positioned on the mounting surface 100, and the first planar member 610 projects perpendicular from the mounting surface 110 towards the inner face of the first projection portion 712. When the ribbed waterstop 602 is used, an approximate first half of the planar member 630 is positioned in the base slab 100, and an approximate second half of the planar member 630 projects out of the base slab 100, perpendicular from the mounting surface 110 towards the inner face of the first projection portion 712. When an expandable waterstop is used, the expandable waterstop is positioned on the mounting surface 110. The inner curb 300 and the outer curb 400 are then cast on both the inside and outside of the wall 200, respectively. The inner curb 300 is cast by pouring concrete on the mounting surface 110 adjacent to the inner surface 220 of the wall 200, covering and encasing the plurality of first projection portions 712, the plurality of inner curb reinforcing crossmembers 740, the first waterstop 600, and the first expandable waterstop 500. After the inner curb 300 has been cast, the first wall contacting surface 320 abuts the inner surface 220, the second base slab contacting surface 330 rests on the mounting surface 110.

The first waterstop 600 is positioned at an approximate midpoint between the inner facing surface 340 and the first wall contacting surface 320, of the inner curb. Similarly, a second waterstop 600 can also be positioned at an approximate midpoint between the outer facing surface 440 and the first wall contacting surface 420 of the outer curb in a similar manner as in the inner curb. In embodiments with the bulb waterstop 601, the center bulb 620 is positioned along an interface of the second base slab contacting surface 330 and the mounting surface 110. The first planar member 610 is positioned in the inner curb 300 and the second planar member 611 is positioned in the base 100. In embodiments with the ribbed waterstop 602, an approximate first half of the planar member 630 is positioned in the base slab 100, and an approximate second half of the planar member 630 is positioned in the inner curb 300. The first waterstop 600 provides a tight seal to prevent water and other liquids from passing along the interface, and leaking out of the container 1.

The first expandable waterstop 500 is positioned along an interface of the first wall contacting surface 320 and the inner surface 220, between the top surface 310 and the second base slab contacting surface 330. In another embodiment, the wall 200 includes a groove into which the first expandable waterstop 500 is positioned before the curb is cast. In yet another embodiment, a second expandable waterstop 500 is positioned along an interface of the second wall contacting surface 420 and the outer surface 420, between the top surface 410 and the third base slab contacting surface 430.

An optional waterstop inspection gap 501 can be positioned between the first wall contacting surface 320 and the inner surface to allow for visual inspection of the first expandable waterstop 500. Alternatively, caulk can be positioned between the first wall contacting surface 320 and the inner surface The outer curb 400 is cast in a similar manner as the inner curb 300. The outer curb 400 is cast by pouring concrete on the mounting surface 110 adjacent to the outer surface 210 of the wall 200, covering and encasing the plurality of second projection portions 722 and the plurality of outer curb reinforcing crossmembers 750. After the outer curb 400 has been cast, the second wall contacting surface 420 abuts the outer surface 210, the third base slab contacting surface 430 rests on the mounting surface 110.

An elastomeric sealant 800, illustrated in FIG. 1, is positioned along the interface of a lower edge of the outer facing surface 440 and the mounting surface 110, and along the interface of a lower edge of the inner facing surface 340 and the mounting surface 110. Additionally, the elastomeric sealant 800 may optionally be positioned along the interface of the top surface 310 and the inner surface 220, and along the interface of the top surface 410 and the outer surface 210. Alternatively, the elastomeric sealant 800 may be positioned in a continuous layer extending from the mounting surface 110, along the inner facing surface 340, along the top surface 310, and along the inner surface 220. In this embodiment, another continuous layer of elastomeric sealant 800 may be positioned extending from the mounting surface 110, along the outer facing surface 440, along the top surface 410, and along the outer surface 210. The elastomeric sealant 800 provides an additional seal to prevent leakage of the contents of the container 1.

The above-described curb system for a concrete container according to the present invention eliminates the need for keyways in a base slab, and allows the container walls to be set on a flat, planar base slab. Thus, the problems associated with the keyways are eliminated.

Although the above embodiments show and describe the curb system for a concrete container 1 as an example, one of ordinary skill in the pertinent art would appreciate that changes or modifications may be made without departing from the principles and spirit of the disclosure, the scope of which is defined in the claims and their equivalents.

For example, while two layers of base slab reinforcing members 120 in different common planes are illustrated in FIGS. 1-4, one, three, four, or five layers of base slab reinforcing members 120 in different common planes can also be used.

In embodiments using the bulb waterstop 601, the center bulb 620 has been described as being tubular, but in alternative embodiments, the center bulb 620 can also be a square, a rectangle, a pentagon, a hexagon, a triangle or other common shapes. Additionally, the bore 621 can also be a variety of shapes, such as circular, square, rectangular, pentagon, hexagonal, triangular or other common shapes. Furthermore, the center bulb 620 can also be used without a bore 621.

Additionally, the first planar member 610 and the second planar member 611 can extend at different lengths in opposite directions from the center bulb 620, such that one planar member is longer than the other planar member. Additionally, the first planar member 610 and the second planar member 611 can further include a plurality of ribs positioned along opposite longitudinal surfaces on each member 610, 611, the ribs projecting perpendicular to the common plane.

In embodiments using the ribbed waterstop 602, the length of the portions inserted into the curb and the base slab 100 can vary in length. For example, the length inserted in the base slab 100 can be longer or shorter than the length inserted in the curb.

The first expandable waterstop 500 can be a solid elongated body having a rectangular or square shape extending from the leading end to the distal end. The center bore 530 can replaced with a solid, continuous material extending between the opposing channels 540*a*, 540*b*, while still having the opposing channels 540*a*, 540*b*. Additionally, the opposing channels 540*a*, 540*b* can be replaced with a solid, continuous material while still having the center bore 530.

In embodiments using two waterstops 600, with one in the inner curb 300 and one in the outer curb 400, the two waterstops 600 can be the same type or can be a different type of waterstop 600. For example, an expandable waterstop can be used in the inner curb 300, and a ribbed waterstop 602 or a bulb waterstop 601 can be used in the inner curb 400, or any combination of types.

What is claimed is:

1. A curb system for a concrete container comprising:
a base slab having a planar mounting surface;
a wall positioned on the planar mounting surface;
an inner curb positioned on the planar mounting surface and adjacent to an inner surface of the wall;
an outer curb positioned on the planar mounting surface and adjacent to an outer surface of the wall;
a first expandable waterstop positioned between the inner curb and the inner surface of the wall; and
a first waterstop positioned between the inner curb and the planar mounting surface.

2. The curb system of claim 1, further comprising a plurality of inner curb reinforcing members extending from the base slab to the inner curb.

3. The curb system of claim 2, wherein the inner curb reinforcing members have a first end portion positioned in the base slab, a first projection portion that projects from the first end portion into the inner curb to form an inverted U-shape, and a second end portion that extends from the first projection portion and is positioned in the base slab.

4. The curb system of claim 3, further comprising a plurality of outer curb reinforcing members extending from the base slab to the outer curb.

5. The curb system of claim 4, wherein the outer curb reinforcing members have a third end portion positioned in the base slab, a second projection portion that projects from the first end portion into the outer curb to form an inverted U-shape, and a fourth end portion that extends from the second projection portion and is positioned in the base slab.

6. The curb system of claim 5, further comprising a connecting portion positioned in the base slab and extending under the wall, the connecting portion connecting the second end portion and the fourth end portion.

7. The curb system of claim 3, further comprising a plurality of inner curb reinforcing crossmembers extending along the plurality of inner curb reinforcing members.

8. The curb system of claim 5, further comprising a plurality of outer curb reinforcing crossmembers extending along the plurality of outer curb reinforcing members.

9. The curb system of claim 1, wherein the wall is precast concrete.

10. The curb system of claim 1, further comprising a shim positioned between the wall and the base slab.

11. The curb system of claim 1, further comprising a second expandable waterstop positioned between the outer curb and the outer surface of the wall.

12. The curb system of claim 1, further comprising a second waterstop positioned between the outer curb and the base slab.

13. The curb system of claim 1, wherein the base slab comprises a plurality of base slab reinforcing members.

14. The curb system of claim 1, further comprising an elastomeric sealant positioned between the outer curb and the outer surface of the wall.

15. The curb system of claim 1, further comprising an elastomeric sealant positioned between the inner curb and the inner surface of the wall.

16. The curb system of claim 1, wherein the first waterstop is a bulb waterstop.

17. The curb system of claim 1, wherein the first waterstop is a ribbed waterstop.

* * * * *